US009276383B2

(12) United States Patent
Ozeki et al.

(10) Patent No.: US 9,276,383 B2
(45) Date of Patent: Mar. 1, 2016

(54) SPARK PLUG, AND PRODUCTION METHOD THEREFOR

(71) Applicant: NGK Spark Plug Co., LTD., Nagoya (JP)

(72) Inventors: Keiji Ozeki, Konan (JP); Tomoaki Kato, Nagoya (JP); Naoyuki Mukoyama, Nisshin (JP); Tsutomu Kobayashi, Inazawa (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/412,076

(22) PCT Filed: Jul. 16, 2013

(86) PCT No.: PCT/JP2013/004341
§ 371 (c)(1),
(2) Date: Dec. 30, 2014

(87) PCT Pub. No.: WO2014/013722
PCT Pub. Date: Jan. 23, 2014

(65) Prior Publication Data

US 2015/0340842 A1 Nov. 26, 2015

(30) Foreign Application Priority Data

Jul. 17, 2012 (JP) ..... 2012-158280
Aug. 28, 2012 (JP) ..... 2012-187283
Jan. 10, 2013 (JP) ..... 2013-002268

(51) Int. Cl.
*H01T 13/20* (2006.01)
*H01T 13/08* (2006.01)
*H01T 21/02* (2006.01)

(52) U.S. Cl.
CPC ..... *H01T 13/08* (2013.01); *H01T 13/20* (2013.01); *H01T 21/02* (2013.01)

(58) Field of Classification Search
CPC ..... H01T 13/20
USPC ..... 313/143, 144, 141
See application file for complete search history.

(56) References Cited

U.S. PATENT DOCUMENTS 5,831,377 A * 11/1998 Matsubara ..... H01T 13/20 313/118
6,091,185 A * 7/2000 Matsubara ..... H01T 13/20 313/118

(Continued)

FOREIGN PATENT DOCUMENTS

JP 10-289777 A 10/1998
JP 2006-092956 A 4/2006

(Continued)

OTHER PUBLICATIONS

International Search Report mailed Aug. 13, 2013 for the corresponding PCT Application No. PCT/JP2013/004341.

*Primary Examiner* — Vip Patel
(74) *Attorney, Agent, or Firm* — Leason Ellis LLP

(57) ABSTRACT

A spark plug includes a ceramic insulator having an engagement portion, and a metallic shell provided around the ceramic insulator and having a protrusion. The protrusion has a diameter-decreasing portion, which seats on the engagement portion via an annular seat packing. On a cross section including an axial line, θs>θp is satisfied, where θp represents an acute angle (°) between a straight line orthogonal to the axial line and the contour of the engagement portion, and θs represents an acute angle (°) between a straight line orthogonal to the axial line and the contour of the diameter-decreasing portion. In the aforementioned cross section, Hvo>Hvi is satisfied, where Hvo represents the Vickers hardness (Hv) of the seat packing at the midpoint of a first line segment, and Hvi represents the Vickers hardness (Hv) of the seat packing at the midpoint of a second line segment.

4 Claims, 8 Drawing Sheets

(56) References Cited

U.S. PATENT DOCUMENTS

| | | | |
|---|---|---|---|
| 2006/0066196 | A1 | 3/2006 | Suzuki |
| 2007/0046162 | A1 | 3/2007 | Moribe et al. |
| 2008/0054778 | A1 | 3/2008 | Kumagai et al. |
| 2011/0181168 | A1 | 7/2011 | Nakamura et al. |

FOREIGN PATENT DOCUMENTS

| | | | |
|---|---|---|---|
| JP | 2007-258142 | A | 10/2007 |
| JP | 2008-84841 | A | 4/2008 |
| WO | WO-2010/035717 | A | 4/2010 |

* cited by examiner (a)

(b)

SPARK PLUG, AND PRODUCTION METHOD THEREFOR

CROSS-REFERENCE TO RELATED PATENT APPLICATIONS

This application is a U.S. National Phase Application under 35 U.S.C. §371 of International Patent Application No. PCT/JP2013/004341, filed Jul. 16, 2013, and claims the benefit of Japanese Patent Applications No. 2012-158280, filed on Jul. 17, 2012, No. 2012-187283, filed Aug. 28, 2012, and No. 2013-002268, filed Jan. 10, 2013, all of which are incorporated by reference in their entirety herein. The International Application was published in Japanese on Jan. 23, 2014 as International Publication No. WO/2014/013722 under PCT Article 21(2).

FIELD OF THE INVENTION

The present invention relates to a spark plug used for, for example, an internal combustion engine, and to a method for producing the spark plug.

BACKGROUND OF THE INVENTION

A spark plug is attached to a combustion apparatus of an internal combustion engine or the like, and is employed for ignition of an air-fuel mixture in a combustion chamber. Generally, a spark plug includes an insulator having an axial hole extending in the direction of an axial line; a center electrode inserted into a forward portion of the axial hole; a metallic shell provided around the insulator; and a ground electrode which is provided at the forward end of the metallic shell and which provides a gap in combination with the center electrode. The metallic shell has, on an inner wall thereof, an annular protrusion which projects inwardly in a radial direction and whose center coincides with the axial line. The insulator is inserted in the metallic shell and crimped thereto by means of a rear end portion of the metallic shell bended through application of a load to the rear end portion, such that an engagement portion provided at the forward end of the insulator seats on a diameter-decreasing portion (i.e., a rear side surface) of the protrusion. An annular plate packing is provided between the engagement portion and the diameter-decreasing portion for the purpose of improving the gas-tightness therebetween (see, for example, Japanese Patent Application Laid-Open (kokai) No. H10-289777).

Problems to be Solved by the Invention

In recent years, demand has arisen for reducing the size (diameter) of a spark plug for the purpose of, for example, increasing the degree of freedom of design of an internal combustion engine or the like. However, such a spark plug with a reduced diameter encounters difficulty in securing a sufficient contact area between a plate packing and an engagement portion or a diameter-decreasing portion, which may cause impairment of gas-tightness.

Conceivable means for solving such a problem is to sandwich the plate packing between the engagement portion and the diameter-decreasing portion by means of a larger load applied during fixation through crimping, to thereby increase the contact pressure of the plate packing against the engagement portion or the diameter-decreasing portion for prevention of impairment of gas-tightness. However, in this case, the protrusion of the metallic shell may be excessively compressed, and the thus-compressed protrusion may deform inwardly in a radial direction (i.e., deformation toward the insulator). The thus-deformed protrusion presses the insulator, which may cause breakage (e.g., cracking) in the insulator, or axial misalignment between the insulator and the metallic shell.

In view of the foregoing, an object of the present invention is to provide a spark plug which can secure favorable gas-tightness and can reliably prevent, for example, breakage of an insulator. Another object of the present invention is to provide a method for producing the spark plug.

SUMMARY OF THE INVENTION

Means for Solving the Problems

Configurations suitable for achieving the aforementioned objects will next be described in itemized form. If needed, actions and effects attributed to the configurations will be described additionally.

Configuration 1: a spark plug comprising:

a tubular insulator having an axial hole extending in a direction of an axial line;

a center electrode inserted into a forward portion of the axial hole; and a tubular metallic shell provided around the insulator and having a protrusion projecting inwardly in a radial direction, wherein the protrusion has a diameter-decreasing portion whose diameter decreases toward the forward end of the metallic shell;

the insulator has, on an outer wall thereof, an engagement portion whose diameter decreases toward the forward end of the insulator; and the engagement portion seats on the diameter-decreasing portion via an annular plate packing, the spark plug being characterized in that, on a longitudinal cross section including the axial line:

a relation of $\theta s > \theta p$ is satisfied, wherein $\theta p$ represents an acute angle (°) between a straight line orthogonal to the axial line and the contour of the engagement portion, and $\theta s$ represents an acute angle (°) between a straight line orthogonal to the axial line and the contour of the diameter-decreasing portion;

the plate packing is disposed so as to include a first line segment extending, in the direction of the axial line, between the rear end of the engagement portion and the diameter-decreasing portion; and a relation of $Hvo > Hvi$ is satisfied, wherein Hvo represents the Vickers hardness (Hv) of the plate packing at the midpoint of the first line segment, and Hvi represents the Vickers hardness (Hv) of the plate packing at the midpoint of a second line segment extending, in the direction of the axial line, between the engagement portion and the forward end of the diameter-decreasing portion which is in contact with the plate packing.

According to the aforementioned configuration 1, a relation of $\theta s > \theta p$ is satisfied. Thus, when the metallic shell and the insulator are fixed to each other through crimping, a larger load is applied to an outer peripheral portion of the diameter-decreasing portion; i.e., the load applied to an inner peripheral portion thereof can be reduced. Therefore, radially inward deformation of the protrusion can be effectively suppressed, whereby breakage of the insulator or axial misalignment between the insulator and the metallic shell can be more reliably prevented.

According to the aforementioned configuration 1, a relation of $Hvo > Hvi$ is satisfied; i.e., the hardness of an outer peripheral portion of the plate packing is higher than that of an inner peripheral portion of the plate packing. Since θs is larger than θp, a large load is applied to the outer peripheral portion of the plate packing sandwiched between the engagement portion and the diameter-decreasing portion. However, the large-load-applied portion of the plate packing exhibits a sufficiently high hardness. Therefore, the contact pressure of the plate packing against the engagement portion or the diameter-decreasing portion can be considerably increased at the outer peripheral portion at which the contact area between the plate packing and the engagement portion or the diameter-decreasing portion is larger than that at the inner peripheral portion. Thus, favorable gas-tightness can be achieved.

Meanwhile, the inner peripheral portion of the plate packing, to which a relatively small load is applied, exhibits a relatively low hardness. Therefore, even when the contact pressure of the plate packing against the engagement portion or the diameter-decreasing portion is low, the inner peripheral portion more reliably adheres to the engagement portion or the diameter-decreasing portion. Thus, very favorable gas-tightness can be achieved in cooperation with a considerable increase in the contact pressure of the outer peripheral portion of the plate packing against the engagement portion or the diameter-decreasing portion.

Configuration 2: a spark plug of the present configuration is characterized in that, in the aforementioned configuration 1, a relation of $1.03 \leq Hvo/Hvi \leq 1.25$ is satisfied.

According to the aforementioned configuration 2, a relation of $Hvo/Hvi \leq 1.25$ is satisfied. Therefore, there can be more reliably prevented a problem that the load applied from an outer peripheral portion of the plate packing toward the protrusion (diameter-decreasing portion) becomes excessively larger than that applied from an inner peripheral portion of the plate packing toward the protrusion (diameter-decreasing portion). Thus, local deformation of the protrusion (diameter-decreasing portion) can be effectively suppressed, and breakage or the like of the insulator, which could be caused by deformation of the protrusion, can be further reliably prevented.

According to the aforementioned configuration 2, a relation of $1.03 \leq Hvo/Hvi$ is also satisfied. Therefore, a well-balanced relationship can be achieved between increased contact pressure of an outer peripheral portion of the plate packing against the engagement portion or the diameter-decreasing portion and increased adhesion of an inner peripheral portion of the plate packing to the engagement portion or the diameter-decreasing portion. Thus, gas-tightness can be further improved.

Configuration 3: a method for producing the spark plug as recited in the aforementioned configuration 1 or 2, the method comprising:

a placement step of placing the insulator in the metallic shell so that the plate packing is placed between the diameter-decreasing portion and the engagement portion; and a crimping step of applying a load to a rear end portion of the metallic shell in a direction of the axial line toward the forward end of the metallic shell, and bending the rear end portion of the metallic shell inwardly in a radial direction, to thereby fix the metallic shell to the insulator so that the plate packing is sandwiched between the diameter-decreasing portion and the engagement portion, the method being characterized in that on a longitudinal cross section of the plate packing provided in the placement step, the cross section including a central axis of the plate packing, an acute angle θpp (°) between a straight line orthogonal to the central axis and the contour of a first end surface of the plate packing which faces the engagement portion is equal to θp, and an acute angle θps (°) between a straight line orthogonal to the central axis and the contour of a second end surface of the plate packing which faces the diameter-decreasing portion is equal to θs.

As used herein, the expression "θpp is equal to θp" encompasses the case where θpp is strictly equal to θp, and the case where θpp slightly differs from θp (e.g., the difference falls within a range of ±2° or thereabouts), whereas the expression "θps is equal to θs" encompasses the case where θps is strictly equal to θs, and the case where θps slightly differs from θs (e.g., the difference falls within a range of ±2° or thereabouts).

Generally, when the metallic shell is fixed to the insulator, the plate packing is provided between the engagement portion and the diameter-decreasing portion in the placement step, and a load is applied to a rear end portion of the metallic shell in the crimping step, to thereby bend the rear end portion of the metallic shell. Thus, the metallic shell is fixed through crimping to the insulator so that the plate packing is sandwiched between the engagement portion and the diameter-decreasing portion.

In a conventional technique, as shown in FIG. 10(*a*), a plate packing 42 placed between an engagement portion 14 and a diameter-decreasing portion 21A in the placement step is configured such that a first end surface 42F facing the engagement portion 14 and a second end surface 42B facing the diameter-decreasing portion 21A respectively extend in a direction orthogonal to the central axis of the plate packing 42 (i.e., the plate packing 42 assumes a flat plate shape). Subsequently, as shown in FIG. 10(*b*), in the crimping step, the plate packing 42 is deformed by a load applied via the engagement portion 14, and, through further application of a load, the plate packing 42 is deformed so that the first end surface 42F or the second end surface 42B follows the engagement portion or the diameter-decreasing portion.

However, in the aforementioned technique, a corner 42E of the plate packing 42 between an inner surface 42N and the first end surface 42F comes into contact with an insulator 41 at an early stage of the crimping step. Therefore, in the crimping step, stress is concentrated at a portion of the insulator 41 which comes into contact with the corner 42E, which may cause breakage (e.g., cracking) in the insulator 41.

In contrast, according to the aforementioned configuration 3, the plate packing employed in the placement step is configured such that the angle θpp corresponding to the first end surface is equal to the angle θp (corresponding to the engagement portion), and the angle θps corresponding to the second end surface is equal to the angle θs (corresponding to the diameter-decreasing portion). That is, in the placement step, the plate packing generally comes into surface contact with the engagement portion and the diameter-decreasing portion. Therefore, in the crimping step, stress concentration at a portion of the insulator can be more reliably prevented. Thus, breakage of the insulator can be further reliably prevented.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 10(*b*) is an enlarged cross-sectional view of, for example, the plate packing in a crimping step according to the conventional technique.

DETAILED DESCRIPTION OF THE INVENTION

Figure 1:
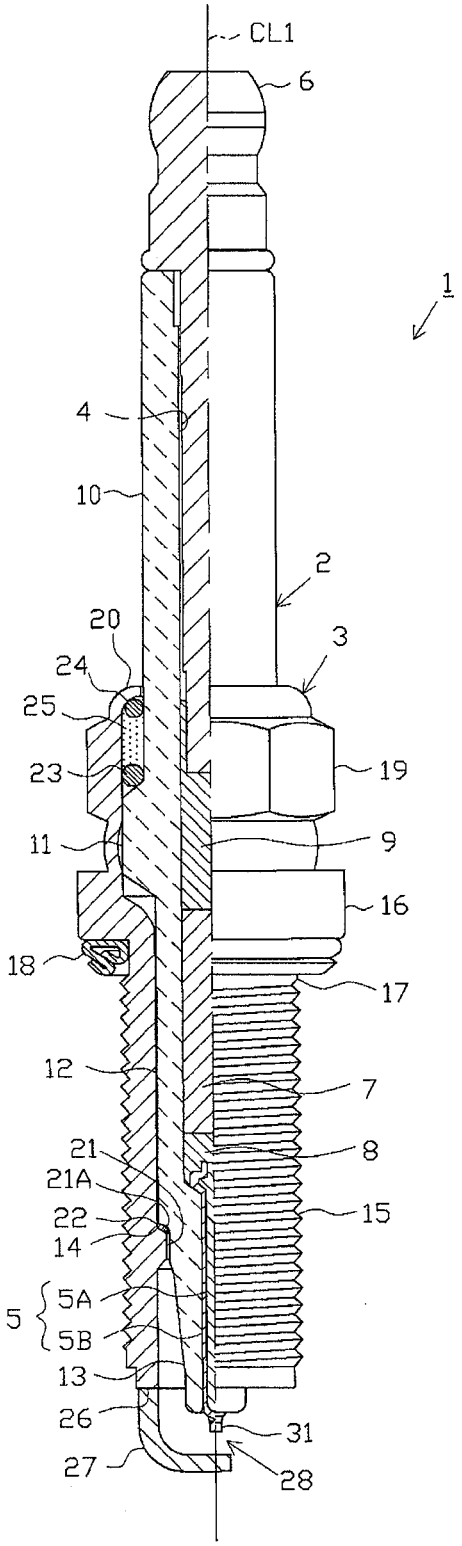
FIG. 1 is a partially sectioned front view of the configuration of a spark plug.

One embodiment will next be described with reference to the drawings. FIG. 1 is a partially sectioned front view of a spark plug 1. In FIG. 1, the direction of an axial line CL1 of the spark plug 1 is referred to as the vertical direction. In the following description, the lower side of the spark plug 1 in FIG. 1 is referred to as the forward end side of the spark plug 1, and the upper side as the rear end side.

The spark plug 1 includes, for example, a tubular ceramic insulator 2, and a tubular metallic shell 3 which holds the insulator 2 therein.

The ceramic insulator 2 is formed from alumina or the like through firing, as well known in the art. The ceramic insulator 2, as viewed externally, includes a rear trunk portion 10 formed on the rear end side; a large-diameter portion 11 which is located forward of the rear trunk portion 10 and projects outwardly in a radial direction; an intermediate trunk portion 12 which is located forward of the large-diameter portion 11 and is smaller in diameter than the large-diameter portion 11; and a leg portion 13 which is located forward of the intermediate trunk portion 12 and is smaller in diameter than the intermediate trunk portion 12. The large-diameter portion 11, the intermediate trunk portion 12, and most of the leg portion 13 of the ceramic insulator 2 are accommodated in the metallic shell 3. In addition, a tapered engagement portion 14 is formed at a connection portion between the intermediate trunk portion 12 and the leg portion 13 such that the diameter of the engagement portion 14 decreases toward the forward end. The ceramic insulator 2 seats on the metallic shell 3 by means of the engagement portion 14.

Furthermore, the ceramic insulator 2 has an axial hole 4 extending therethrough along the axial line CL1. A center electrode 5 is inserted in and fixed to a forward end portion of the axial hole 4. The center electrode 5 includes an inner layer 5A formed of a metal exhibiting excellent thermal conductivity [e.g., copper, a copper alloy, or pure nickel (Ni)], and an outer layer 5B formed of an alloy containing Ni as a main component. The center electrode 5 generally assumes a rod shape (circular columnar shape), and a forward end portion thereof projects from the forward end of the ceramic insulator 2. In the present embodiment, a circular columnar tip 31 formed of a metal exhibiting excellent erosion resistance (e.g., an iridium alloy or a platinum alloy) is provided at the forward end of the center electrode 5 for the purpose of improving durability.

Also, a terminal electrode 6 is inserted in and fixed to a rear end portion of the axial hole 4 and projects from the rear end of the ceramic insulator 2.

A circular columnar resistor 7 is provided within the axial hole 4 between the center electrode 5 and the terminal electrode 6. Opposite end portions of the resistor 7 are electrically connected to the center electrode 5 and the terminal electrode 6, respectively, via electrically conductive glass sealing layers 8 and 9.

The metallic shell 3 is formed of a metal such as low-carbon steel (e.g., 525C) and assumes a tubular shape. The metallic shell 3 has, on an outer wall thereof, a threaded portion (externally threaded portion) 15 adapted to mount the spark plug 1 on a combustion apparatus (e.g., an internal combustion engine or a fuel cell reformer). Also, the metallic shell 3 has thereon a seat portion 16 which is located rearward of the threaded portion 15 and which protrudes outwardly. A ring-like gasket 18 is fitted onto a screw neck 17 at the rear end of the threaded portion 15. Furthermore, the metallic shell 3 has, on a rear end portion thereof, a tool engagement portion 19 having a hexagonal cross section for engaging a tool (e.g., a wrench) with the portion 19 during mounting of the metallic shell 3 on the combustion apparatus. Also, the metallic shell 3 has, at the rear end thereof, a crimp portion 20 which is bent inwardly in a radial direction. In the present embodiment, in order to reduce the diameter of the spark plug 1, the metallic shell 3 has a small diameter, and the threaded portion 15 has a relatively small diameter (e.g., M12 or less). In association with a reduction in diameter of the metallic shell 3, the diameter of the ceramic insulator 2, which is provided inside the metallic shell 3, is also reduced, and the ceramic insulator 2 has a relatively small thickness.

The metallic shell 3 has, on an inner wall thereof, a protrusion 21 which projects inwardly in a radial direction, and the protrusion 21 has a tapered diameter-decreasing portion 21A whose diameter decreases toward the forward end (the portion 21A corresponds to a rear side surface of the protrusion 21). The ceramic insulator 2 is inserted forward into the metallic shell 3 from the rear end of the metallic shell 3. While the engagement portion 14 of the ceramic insulator 2 seats on the diameter-decreasing portion 21A via an annular plate packing 22 formed of a specific metal (e.g., copper, iron, or SUS), a rear opening portion of the metallic shell 3 is crimped inwardly in a radial direction; i.e., the aforementioned crimp portion 20 is formed, whereby the ceramic insulator 2 is fixed to the metallic shell 3. The plate packing 22 provided between the engagement portion 14 and the diameter-decreasing portion 21A maintains the gas-tightness of a combustion chamber, and prevents outward leakage of a fuel gas which enters the clearance between the inner wall of the metallic shell 3 and the leg portion 13 of the ceramic insulator 2, which is exposed to the combustion chamber.

Furthermore, in order to achieve more reliable gas-tightness through crimping, annular ring members 23 and 24 are provided between the metallic shell 3 and the ceramic insulator 2 at a rear end portion of the metallic shell 3, and a space between the ring members 23 and 24 is filled with powder of talc 25. That is, the metallic shell 3 holds the ceramic insulator 2 via the plate packing 22, the ring members 23 and 24, and the talc 25.

A ground electrode 27 is bonded to the forward end 26 of the metallic shell 3 such that the ground electrode 27 is bent at an intermediate portion thereof, and a distal side surface of the ground electrode 27 faces a forward end portion (chip 31) of the center electrode 5. Also, a gap 28 is provided between the forward end portion (chip 31) of the center electrode 5 and the distal end portion of the ground electrode 27, and spark discharge occurs at the gap 28 generally in a direction along the axial line CL1.

Next will be described the configurations of the engagement portion 14, the diameter-decreasing portion 21A, and the plate packing 22 provided between the portions 14 and 21A, which are characteristic features of the present invention.

Figure 2:
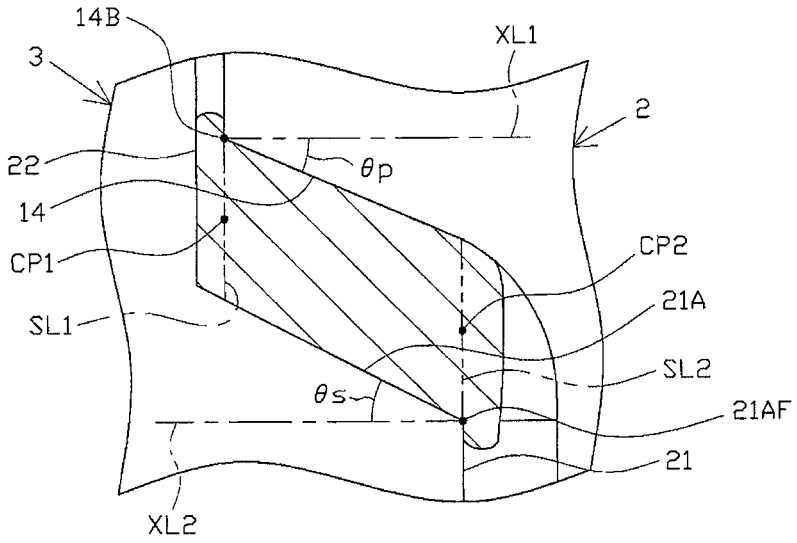
FIG. 2 is an enlarged cross-sectional view of a diameter-decreasing portion and an engagement portion, which shows, for example, the angles of these portions.

In the present embodiment, as shown in FIG. 2 (in FIG. 2, the ceramic insulator 2 and the metallic shell 3 are not hatched for the sake of convenience), on a longitudinal cross section including the axial line CL1, a relation of $\theta s > \theta p$ is satisfied, wherein $\theta p$ represents the angle (°) of the engagement portion 14, and $\theta s$ represents the angle (°) of the diameter-decreasing portion 21A.

The angle $\theta p$ corresponds to an acute angle between a straight line XL1 orthogonal to the axial line CL1 and the contour of the engagement portion 14 in the aforementioned cross section, whereas the angle $\theta s$ corresponds to an acute angle between a straight line XL2 orthogonal to the axial line CL1 and the contour of the diameter-decreasing portion 21A in the aforementioned cross section.

Figure 3:
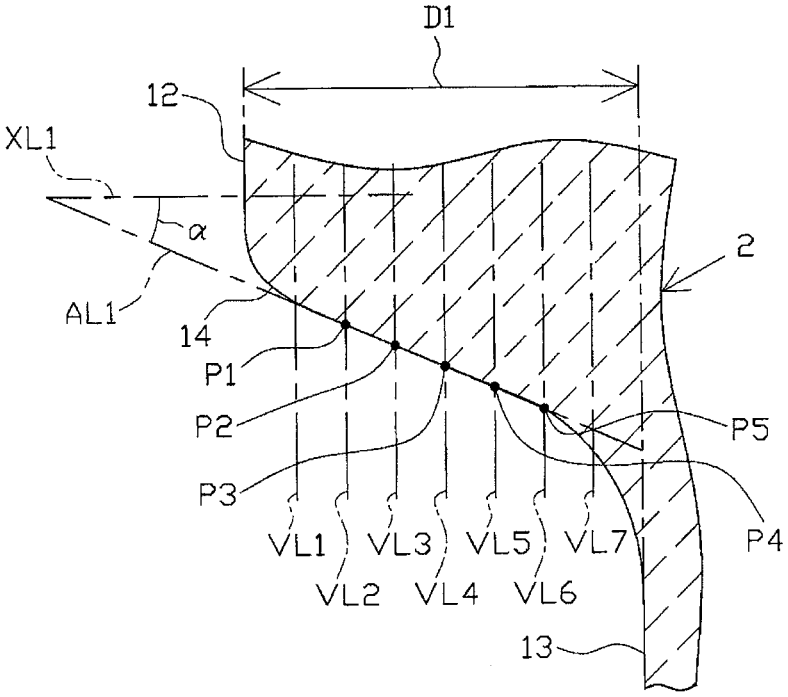
FIG. 3 is a schematic cross-sectional view of an engagement portion whose contour is curved or bent, which illustrates a method for determining the angle of the engagement portion.

In the case where the contour of the engagement portion 14 is curved or bent, the angle $\theta p$ may be determined as follows. Specifically, as shown in FIG. 3, on one side with respect to the axial line CL1, a radius difference D1 is obtained, by means of a projector, by subtracting the radius of the leg portion 13 (i.e., the radius of the engagement portion 14 at the forward end thereof) from the radius of the intermediate trunk portion 12 (i.e., the radius of the engagement portion 14 at the rear end thereof). When the intermediate trunk portion 12 is tapered, the radius difference D1 is obtained by subtracting the radius of the leg portion 13 at the rear end thereof from the radius at a point of intersection between an extended line of the contour of the intermediate trunk portion 12 at the forward end thereof and an extended line of the contour of the engagement portion 14 (i.e., the distance between the axial line and the intersection point). Subsequently, seven virtual lines VL1 to VL7 are drawn so as to extend along the axial line CL1 and to divide the radius difference D1 into eight equal parts in a direction orthogonal to the axial line CL1. Then, there are determined, by means of the projector, coordinates of intersection points P1 to P5 between the contour of the engagement portion 14 and the five virtual lines VL2 to VL6 of the seven virtual lines VL1 to VL7 (i.e., exclusive of the outermost virtual line VL1 and the innermost virtual line VL7). Next, there is determined an acute angle $\alpha$ between an approximate straight line AL1 corresponding to the above-determined five coordinates and the straight line XL1 orthogonal to the axial line CL1. On the other side with respect to the axial line CL1, there is also determined, in the same manner as described above, an angle $\alpha$ between an approximate straight line corresponding to the resultant five coordinates and the straight line XL1 orthogonal to the axial line CL1. The thus-determined two angles $\alpha$ are averaged. In the present embodiment, the average of the two angles $\alpha$ is regarded as the angle $\theta p$.

In the case where the contour of the diameter-decreasing portion 21A is curved or bent, the angle $\theta s$ may be determined as follows.

Figure 4:
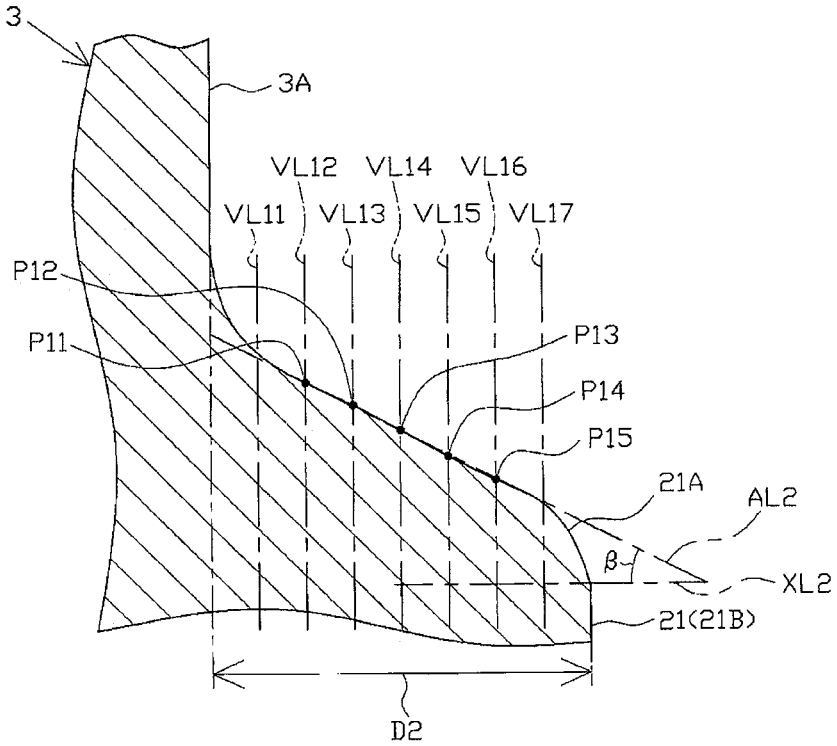
FIG. 4 is a schematic cross-sectional view of a diameter-decreasing portion whose contour is curved or bent, which illustrates a method for determining the angle of the diameter-decreasing portion.

Specifically, as shown in FIG. 4, on one side with respect to the axial line CL1, a radius difference D2 is obtained, by means of a projector, by subtracting the radius of a portion 21B of the protrusion 21, the portion 21B extending from the forward end of the diameter-decreasing portion 21A toward the forward end side (more specifically, the radius of the innermost portion of the portion 21B) from the radius of a portion 3A of the metallic shell 3, the portion 3A extending from the rear end of the diameter-decreasing portion 21A toward the rear end side.

Subsequently, seven virtual lines VL11 to VL17 are drawn so as to extend along the axial line CL1 and to divide the radius difference D2 into eight equal parts in a direction orthogonal to the axial line CL1.

Then, there are determined, by means of the projector, coordinates of intersection points P11 to P15 between the contour of the diameter-decreasing portion 21A and the five virtual lines VL12 to VL16 of the seven virtual lines VL11 to VL17 (i.e., exclusive of the outermost virtual line VL11 and the innermost virtual line VL17).

Next, there is determined an acute angle $\beta$ between an approximate straight line AL2 corresponding to the above-determined coordinates of the five intersection points P11 to P15 and the straight line XL2 orthogonal to the axial line CL1.

On the other side with respect to the axial line CL1, there is also determined, in the same manner as described above, an angle $\beta$ between an approximate straight line corresponding to the resultant five coordinates and the straight line XL2 orthogonal to the axial line CL1. The thus-determined two angles $\beta$ are averaged.

In the present embodiment, the average of the two angles $\beta$ is regarded as the angle $\theta s$.

Referring back to FIG. 2, in the aforementioned cross section, the plate packing 22 is disposed so as to include a first line segment SL1 extending, in the direction of the axial line CL1, between the rear end 143 of the engagement portion 14 and the diameter-decreasing portion 21A. In other words, the plate packing 22 is disposed so as to extend over the entire region between the rear end 14B of the engagement portion 14 and a portion of the diameter-decreasing portion 21A opposite the rear end 14B in the direction of the axial line CL1.

In the aforementioned cross section, the plate packing 22 is disposed so as to include a second line segment SL2 extending, in the direction of the axial line CL1, between the engagement portion 14 and the forward end 21AF of the diameter-decreasing portion 21A which is in contact with the plate packing 22. In other words, the plate packing 22 is disposed so as to extend over the entire region between the forward end 21AF and a portion of the engagement portion 14 opposite the forward end 21AF in the direction of the axial line CL1.

In the present embodiment, in the aforementioned cross section, a relation of $Hvo > Hvi$ is satisfied, wherein Hvo represents the Vickers hardness (Hv) of the plate packing 22 at the midpoint CP1 of the first line segment SL1, and Hvi represents the Vickers hardness (Hv) of the plate packing 22 at the midpoint CP2 of the second line segment SL2. That is, the plate packing 22 is configured such that the hardness of an outer peripheral portion is higher than that of an inner peripheral portion.

In the present embodiment, a relation of $1.03 \leq Hvo/Hvi \leq 1.25$ is satisfied. In the present embodiment, Hvo is 115 Hv to 268 Hv, and Hvi is 109 Hv to 213 Hv. The hardness of the plate packing 22 may be determined through, for example, the method specified by JIS 22244. Specifically, a specific load (e.g., 1.961 N) is applied to the plate packing 22 by means of a square pyramidal diamond indenter, and the hardness of the plate packing 22 is determined on the basis of the length of the diagonal line of an indentation formed on the plate packing 22.

Next will be described a method for producing the spark plug 1 having the aforementioned configuration.

Firstly, the ceramic insulator 2 is formed through molding. For example, a granular material for molding is prepared from a powdery raw material predominantly containing alumina and also containing a binder or the like, and the granular material is subjected to rubber press molding, to thereby produce a tubular molded product. The molded product is subjected to grinding for shaping, and the thus-shaped molded product is fired, to thereby form the ceramic insulator 2.

The center electrode 5 is produced separately from the ceramic insulator 2. Specifically, the center electrode 5 is produced through forging of an Ni alloy body including, in the center thereof, a copper alloy or the like for improving heat radiation property. The tip 31 is bonded to the forward end of the center electrode 5 through, for example, laser welding.

The above-produced ceramic insulator 2 and center electrode 5, the resistor 7, and the terminal electrode 6 are hermetically fixed together by means of the glass sealing layers 8 and 9. The glass sealing layers 8 and 9 are generally prepared from a mixture of borosilicate glass and metal powder. After the thus-prepared layers have been charged in the axial hole 4 of the ceramic insulator 2 so as to sandwich the resistor 7, while pressure is applied to the layers by the terminal electrode 6 from the rear side, the layers are fired through heating in a firing furnace. During this firing process, a glaze layer may be formed through firing on the rear trunk portion 10 of the ceramic insulator 2. Alternatively, the glaze layer may be formed before the firing process.

Next, the metallic shell 3 is produced. Specifically, a circular columnar metal material (e.g., an iron material such as S17C or S25C, or a stainless steel material) is subjected to, for example, cold forging so as to form a through hole therein and to impart a rough shape thereto. Thereafter, the resultant product is subjected to machining for shaping, to thereby produce a metallic shell intermediate.

Subsequently, the straight rod-like ground electrode 27 formed of an Ni alloy or the like is bonded to the forward end surface of the metallic shell intermediate through resistance welding. During this welding process, so-called "roll off" occurs. Therefore, after removal of a "roll-off" portion, the threaded portion 15 is formed on a specific position of the metallic shell intermediate by thread rolling. Thus, the metallic shell 3 having the ground electrode 27 bonded thereto is produced. For improvement of corrosion resistance, the metallic shell 3 to which the ground electrode 27 has been welded may be subjected to plating treatment.

Thereafter, the ceramic insulator 2 having the above-produced center electrode 5 and terminal electrode 6 is fixed to the metallic shell 3 having the ground electrode 27, which will be described below in detail.

Figure 5:
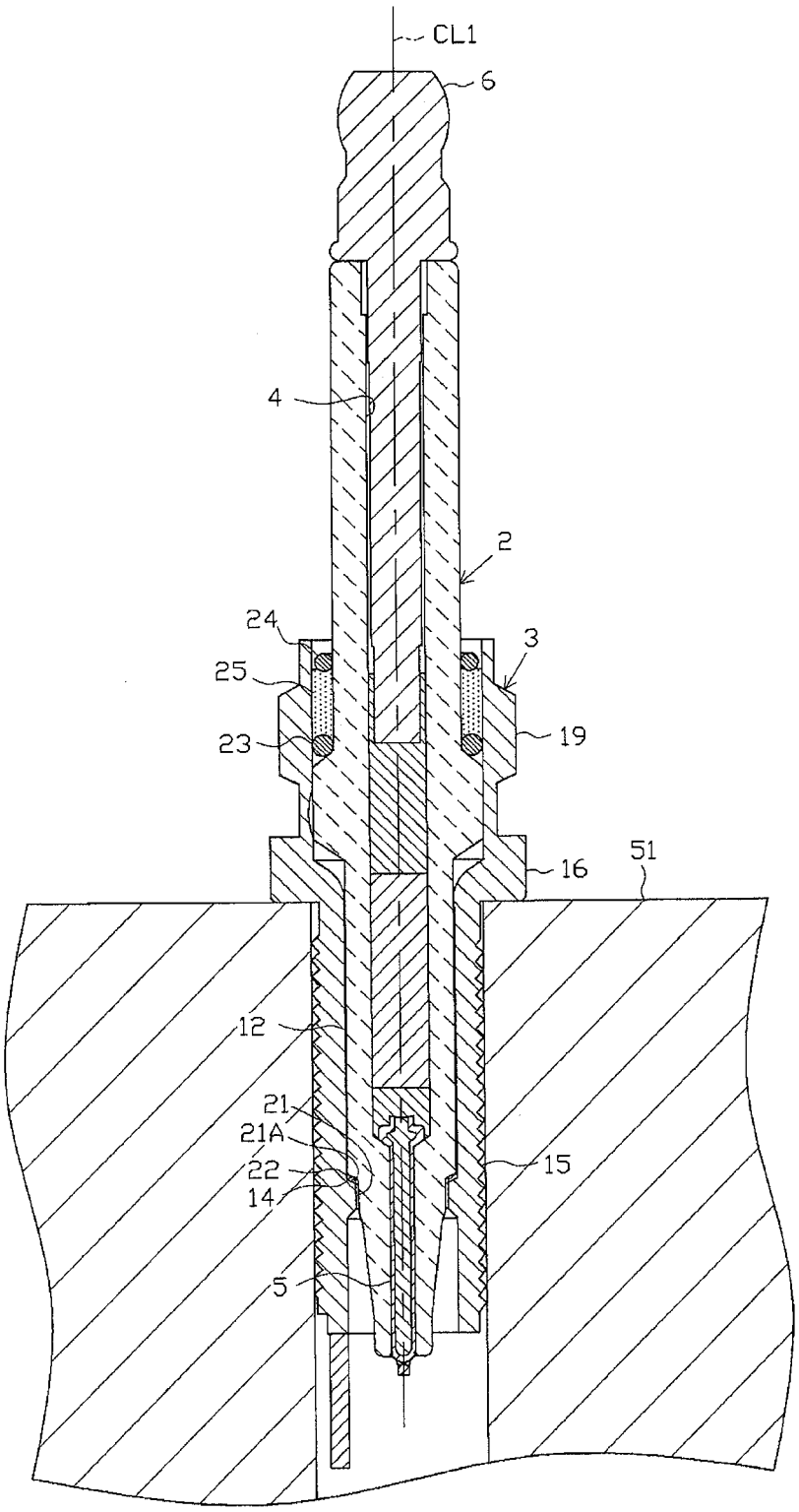
FIG. 5 is a cross-sectional view of a metallic shell held by a receiving die in a placement step.

As shown in FIG. 5, firstly, in the placement step, a forward portion of the metallic shell 3 is inserted into a tubular receiving die 51 formed of a specific metal (e.g., hard steel such as quenched steel), whereby the metallic shell 3 is held by the receiving die 51. Subsequently, the plate packing 22 is inserted into the metallic shell 3, and the plate packing 22 is placed on the diameter-decreasing portion 21A. Then, the ceramic insulator 2 is inserted into the metallic shell 3; specifically, the ceramic insulator 2 is placed in the metallic shell 3 so that the plate packing 22 is provided between the diameter-decreasing portion 21A and the engagement portion 14.

Figure 6:
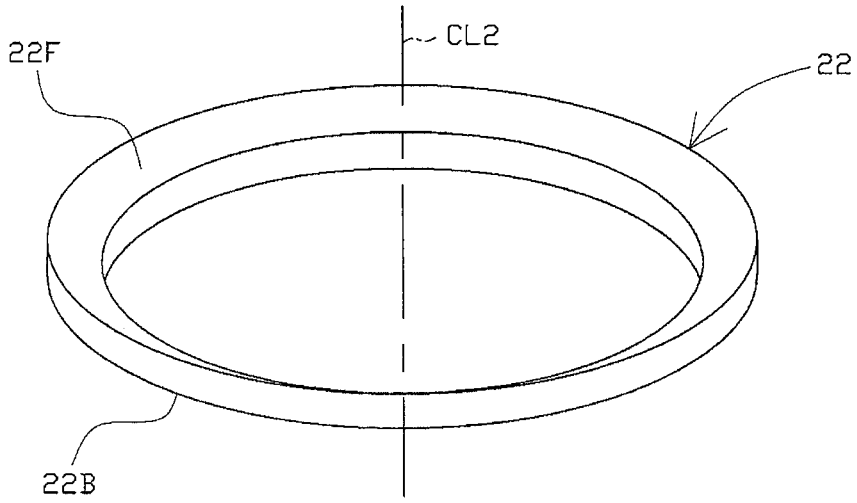
FIG. 6 is a perspective view of the configuration of a plate packing.
Figure 7:
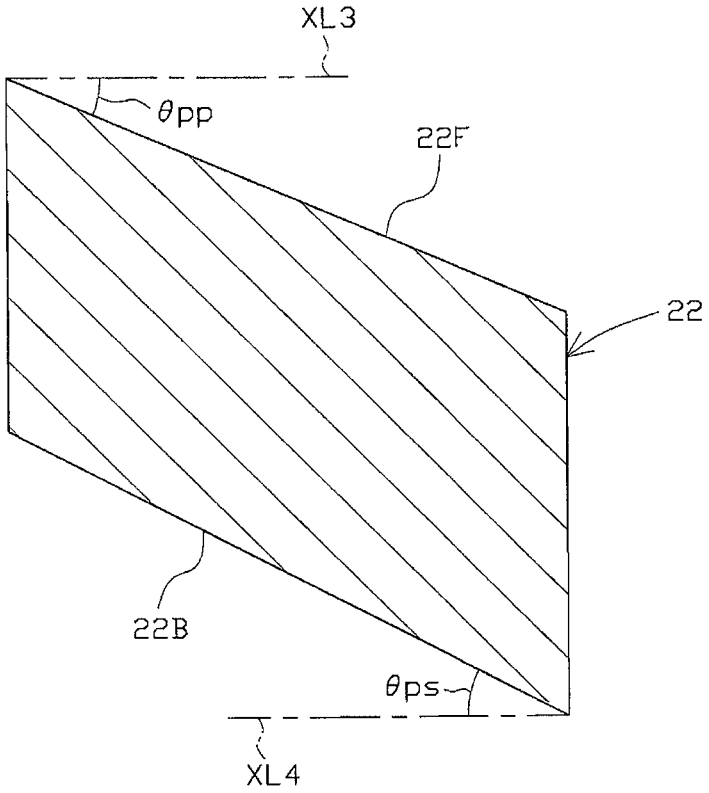
FIG. 7 is an enlarged end view of the configuration of the plate packing.

In the placement step, as shown in FIG. 6, there is provided the plate packing 22 having a first end surface 22F which faces the engagement portion 14, and a second end surface 22B which faces the diameter-decreasing portion 21A, the surfaces 22F and 22B being inclined downwardly toward the central axis CL2 of the plate packing 22. Specifically, as shown in FIG. 7, on a longitudinal cross section of the plate packing 22 including the central axis CL2, an acute angle θpp (°) between a straight line XL3 orthogonal to the central axis CL2 and the contour of the first end surface 22F is equal to θp (i.e., the angle of the engagement portion 14), and an acute angle θps (°) between a straight line XL4 orthogonal to the central axis CL2 and the contour of the second end surface 22B is equal to θs (i.e., the angle of the diameter-decreasing portion 21A). That is, in the placement step (i.e., the step before the crimping step), the plate packing 22 is provided between the engagement portion 14 and the diameter-decreasing portion 21A so that the first end surface 22F comes into surface contact with the engagement portion 14, and the second end surface 223 comes into surface contact with the diameter-decreasing portion 21A. The angle θpp may slightly differ from the angle θp (e.g., the difference falls within a range of ±2° or thereabouts). Alternatively, the angle θps may slightly differ from the angle θs (e.g., the difference falls within a range of ±2° or thereabouts).

Figure 8:
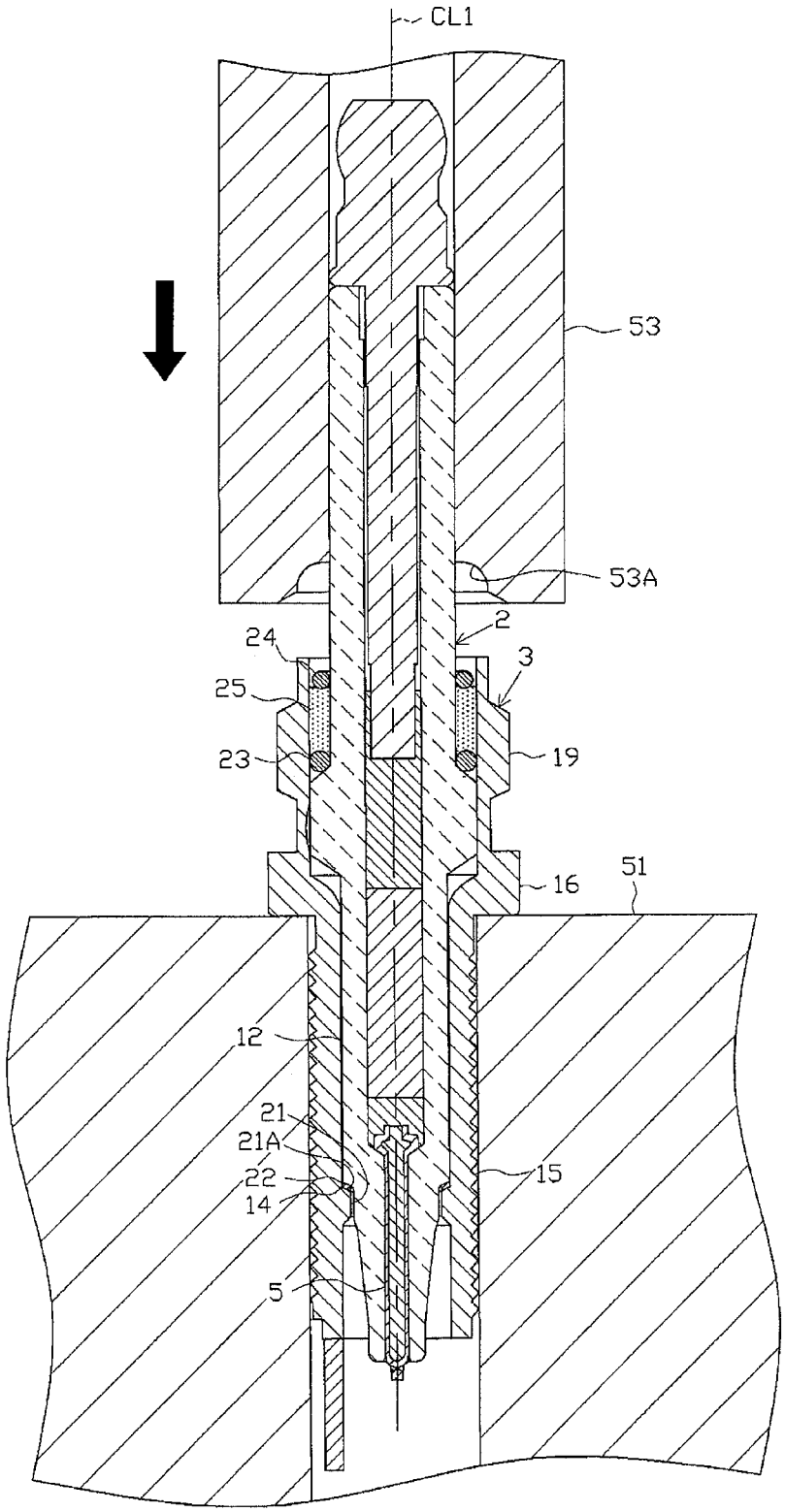
FIG. 8 is a cross-sectional view of, for example, a pressing die employed in a crimping step.
Figure 9:
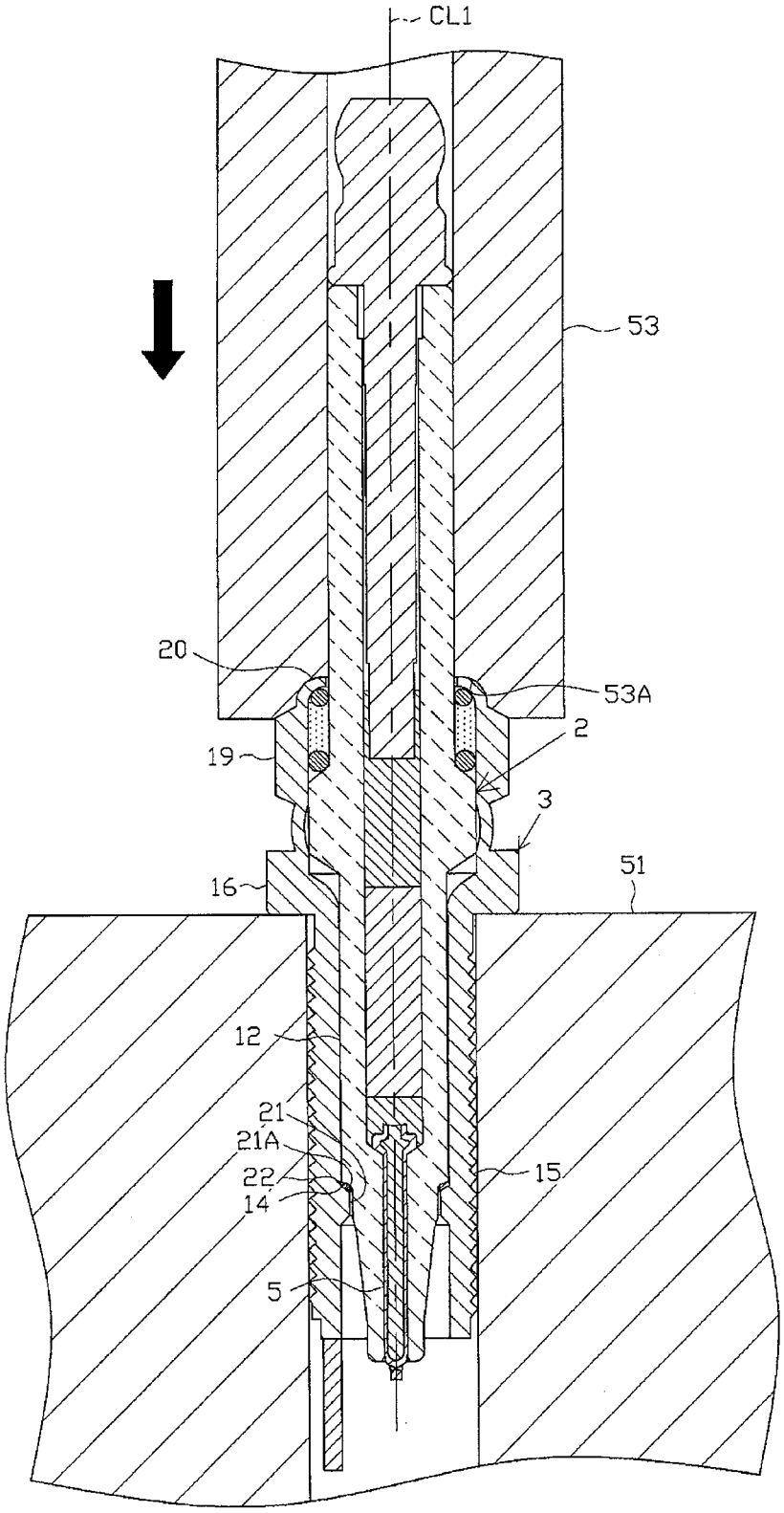
FIG. 9 cross-sectionally shows the state where a load is applied to a rear end portion of the metallic shell in the crimping step.
Figure 10:
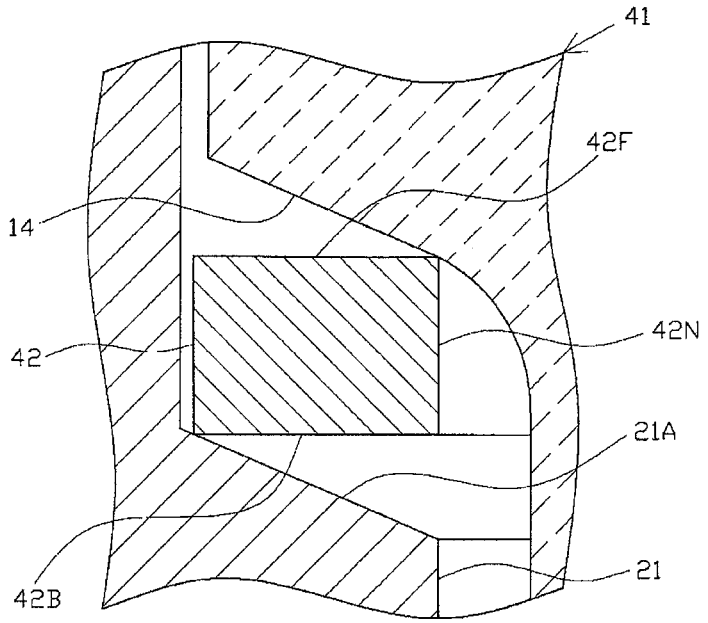
FIG. 10(*a*) is an enlarged cross-sectional view of, for example, a plate packing in a placement step according to a conventional technique.
Figure 10:
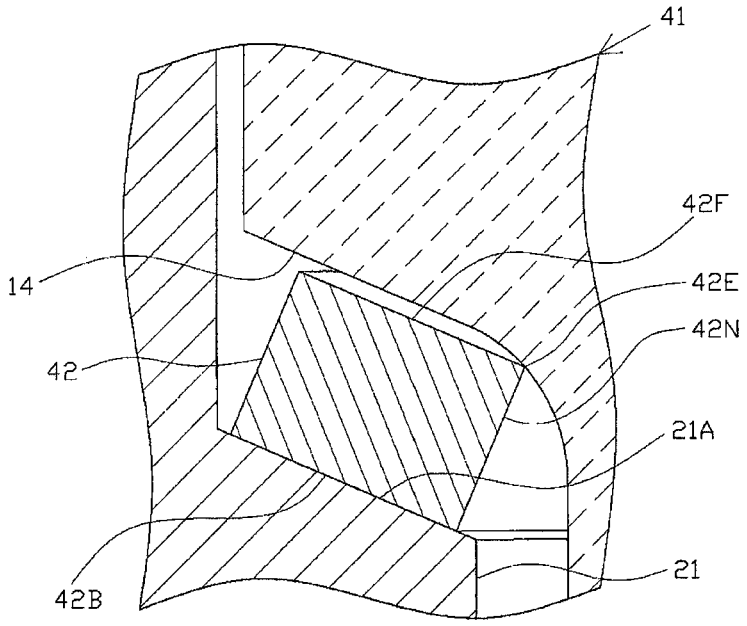

Subsequently, as shown in FIG. 8, a tubular pressing die 53 is provided from above the metallic shell 3. The tubular pressing die 53 has, at a forward opening thereof, a curved inner wall 53A corresponding to the shape of the crimp portion 20. After provision of the pressing die 53, while the metallic shell 3 is sandwiched between the receiving die 51 and the pressing die 53, the metallic shell 3 is pressed by the pressing die 53 toward the receiving die 51 at a specific load (e.g., 30 kN to 50 kN). Thus, as shown in FIG. 9, a rear opening portion of the metallic shell 3 is bent inwardly in a radial direction (i.e., the crimp portion 20 is formed), whereby the ceramic insulator 2 is fixed to the metallic shell 3. Through application of a load from the pressing die 53, a relatively thin tubular portion located between the seat portion 16 and the tool engagement portion 19 is curved (deformed) outwardly in a radial direction. Thus, axial force along the axial line CL1 is applied from the metallic shell 3 to the ceramic insulator 2, whereby the ceramic insulator 2 is more reliably fixed to the metallic shell 3.

After fixation of the metallic shell 3 and the ceramic insulator 2, the ground electrode 27 is bent toward the center electrode 5, and the size of the gap 28 provided between the forward end portion of the center electrode 5 and the distal end portion of the ground electrode 27 is adjusted, to thereby produce the aforementioned spark plug 1.

As described above in detail, according to the present embodiment, a relation of θs>θp is satisfied. Thus, in the crimping step, a larger load is applied to an outer peripheral portion of the diameter-decreasing portion 21A; i.e., the load applied to an inner peripheral portion of the diameter-decreasing portion 21A can be reduced. Therefore, radially inward deformation of the protrusion 21 can be effectively suppressed, whereby breakage of the ceramic insulator 2 or axial misalignment between the ceramic insulator 2 and the metallic shell 3 can be more reliably prevented.

Particularly when the threaded portion 15 has a small diameter, and the ceramic insulator 2 has a small thickness as in the case of the present embodiment, there is a concern that the ceramic insulator 2 may be broken due to deformation of the protrusion 21. However, with the aforementioned configuration, breakage of the ceramic insulator 2 can be more reliably prevented. That is, satisfaction of a relation of θs>θp is particularly effective for the spark plug in which the threaded portion 15 has a small diameter (e.g., M12 or less) and there is a concern about breakage of the ceramic insulator 2 due to deformation of the protrusion 21.

In the present embodiment, a relation of Hvo>Hvi is satisfied; i.e., the hardness of an outer peripheral portion of the plate packing 22 is higher than that of an inner peripheral portion of the plate packing 22. Since θs is larger than θp, a large load is applied to the outer peripheral portion of the plate packing 22 sandwiched between the engagement portion 14 and the diameter-decreasing portion 21A. However, the large-load-applied portion of the plate packing 22 exhibits a sufficiently high hardness. Therefore, the contact pressure of the plate packing 22 against the engagement portion 14 or the diameter-decreasing portion can be considerably increased at the outer peripheral portion at which the contact area between the plate packing 22 and the engagement portion 14 or the diameter-decreasing portion is larger than that at the inner peripheral portion. Thus, favorable gas-tightness can be achieved.

Meanwhile, the inner peripheral portion of the plate packing 22, to which a relatively small load is applied, exhibits a relatively low hardness. Therefore, even when the contact pressure of the plate packing 22 against the engagement portion 14 or the diameter-decreasing portion is low, the inner peripheral portion more reliably adheres to the engagement portion 14 or the diameter-decreasing portion. Thus, very favorable gas-tightness can be achieved in cooperation with a considerable increase in the contact pressure of the outer peripheral portion of the plate packing 22 against the engagement portion 14 or the diameter-decreasing portion.

In addition, a relation of Hvo/Hvi 1.25 is satisfied. Therefore, there can be more reliably prevented a problem that the load applied from an outer peripheral portion of the plate packing 22 toward the protrusion 21 (diameter-decreasing portion 21A) becomes excessively larger than that applied from an inner peripheral portion of the plate packing 22 toward the protrusion 21 (diameter-decreasing portion 21A). Thus, local deformation of the protrusion 21 (diameter-decreasing portion 21A) can be effectively suppressed, and breakage or the like of the ceramic insulator 2, which could be caused by deformation of the protrusion 21, can be further reliably prevented.

Also, a relation of 1.03≤Hvo/Hvi is satisfied. Therefore, there can be maintained a well-balanced relationship between the contact pressure of an outer peripheral portion of the plate packing 22 against the engagement portion 14 or the diameter-decreasing portion and the adhesion of an inner peripheral portion of the plate packing 22 to the engagement portion 14 or the diameter-decreasing portion. Thus, gas-tightness can be further improved.

Furthermore, the plate packing 22 employed in the placement step is configured such that the angle θpp corresponding to the first end surface 22F is equal to the angle θp (of the engagement portion 14), and the angle θps corresponding to the second end surface 22B is equal to the angle θs (of the diameter-decreasing portion 21A). That is, in the placement step, the plate packing 22 generally comes into surface contact with the engagement portion 14 and the diameter-decreasing portion 21A. Therefore, in the crimping step, stress concentration at a portion of the ceramic insulator 2 can be more reliably prevented. Thus, breakage of the ceramic insulator 2 can be further reliably prevented.

In order to determine the effects exerted by the aforementioned embodiment, there were prepared, through the aforementioned crimping step, spark plug samples including different plate packings with varied θp and θs (i.e., varied θp−θs (°)) in which a relation of Hvo≤Hvi or Hvo>Hvi is satisfied. Each sample was subjected to a test for determining deformation of a protrusion (hereinafter may be referred to as "protrusion deformation determination test") and an gas-tightness evaluation test.

The protrusion deformation determination test was carried out as follows.

Specifically, five samples were prepared, through the crimping step, so as to have the same relationship between Hvo and Hvi and the same difference θp−θs. A longitudinal cross section of each sample was observed, to thereby determine whether or not a protrusion was deformed inwardly in a radial direction.

When no protrusion deformation was determined in all the five samples, rating "O" was assigned (i.e., radially inward deformation of a protrusion can be effectively suppressed, and thus breakage or the like of the ceramic insulator, which could be caused by protrusion deformation, can be more reliably prevented).

In contrast, when protrusion deformation was determined in at least one of the five samples, rating "Δ" was assigned (i.e., there is a slight concern about breakage or the like of the ceramic insulator, which could be caused by protrusion deformation).

The gas-tightness evaluation test was carried out as follows. Specifically, each sample was attached to a specific aluminum bush, and a pressure (air pressure) of 1.5 MPa was continuously applied to the tip end of the sample. Then, the temperature of a portion (seating surface) of the aluminum bush which was in contact with a gasket was gradually elevated, and there was measured the temperature of the seating surface at the time when the amount of air leaking between the ceramic insulator and the metallic shell was 10 cc/minute or more (hereinafter the temperature will be referred to as "10 cc leakage temperature"). When the 10 cc leakage temperature was 240° C. or higher, rating "O" was assigned (i.e., excellent gas-tightness). When the 10 cc leakage temperature was 230° C. or higher and lower than 240° C., rating "Δ" was assigned (i.e., slightly poor gas-tightness). When the 10 cc leakage temperature was 200° C. or higher and lower than 230° C., rating "X" was assigned (i.e., poor gas-tightness).

Table 1 shows the results of both tests. Hvi or Hvo was changed by regulating, for example, a load applied in the crimping step.

TABLE 1

| | | θs − θp (°) | | | | | |
|---|---|---|---|---|---|---|---|
| | | −3 | −1 | 0 | 1 | 3 | 5 |
| Hvo ≤ Hvi | Protrusion deformation evaluation | Δ | Δ | ○ | ○ | ○ | ○ |
| | Gas-tightness evaluation | Δ | Δ | X | Δ | Δ | Δ |
| Hvo > Hvi | Protrusion deformation evaluation | Δ | Δ | ○ | ○ | ○ | ○ |
| | Gas-tightness evaluation | Δ | X | X | ○ | ○ | ○ |

As is clear from Table 1, protrusion deformation was likely to occur in a sample in which θs−θp was −1° or less (i.e., θs≤θp). Conceivably, this is attributed to the fact that a larger load was applied to an inner peripheral portion of the protrusion (diameter-decreasing portion) in the crimping step.

A sample in which Hvo≤Hvi was found to exhibit poor gas-tightness. Conceivably, this is attributed to the fact that the contact pressure of the plate packing against the engagement portion or the diameter-decreasing portion was insufficient at an outer peripheral portion of the plate packing (the portion is in contact with the engagement portion or the diameter-decreasing portion in a larger area, and thus is important for securing gas-tightness), and that the adhesion of the plate packing to the engagement portion or the diameter-decreasing portion was insufficient at an inner peripheral portion of the plate packing.

A sample in which Hvo>Hvi and θs−θp was 0° or less (i.e., θs≤θp) was found to exhibit poor gas-tightness. Conceivably, this is attributed to the fact that the contact pressure of the plate packing against the engagement portion or the diameter-decreasing portion was insufficient at an outer peripheral portion of the plate packing.

In contract, a sample in which a relation of Hvo>Hvi was satisfied, and θs−θp was 1° or more (i.e., θs>θp) was found to exhibit an excellent effect of preventing protrusion deformation, and excellent gas-tightness. Conceivably, this is attributed to synergistic effects of the following (1) to (4): (1) since a relation of θs>θp was satisfied, a larger load was applied to an outer peripheral portion of the protrusion (diameter-decreasing portion) in the crimping step, and radially inward deformation of the protrusion was suppressed; (2) since a relation of θs>θp was satisfied, a large load was applied to an outer peripheral portion of the plate packing; (3) since a relation of Hvo>Hvi was satisfied, in cooperation with the effect described above in (2), the contact pressure of the plate packing against the engagement portion or the diameter-decreasing portion was very high at an outer peripheral portion of the plate packing; and (4) since a relation of Hvo>Hvi was satisfied, the adhesion of the plate packing to the engagement portion or the diameter-decreasing portion was sufficiently high at an inner peripheral portion of the plate packing.

The aforementioned test data indicate that satisfaction of a relation of θs>θp and Hvo>Hvi is preferred, from the viewpoints of securing excellent gas-tightness, and more reliably preventing breakage or the like of the ceramic insulator caused by protrusion deformation.

Next, there were prepared a plurality of spark plug samples including different plate packings formed of copper, iron, or SUS (stainless steel) with varied Hvo and Hvi. Each sample was subjected to the above-described protrusion deformation determination test and gas-tightness evaluation test.

In the protrusion deformation determination test, there were determined whether or not radially inward deformation occurred in the protrusion, as well as whether or not concave deformation occurred in the diameter-decreasing portion. When neither radially inward deformation of the protrusion nor concave deformation of the diameter-decreasing portion was determined in all the five samples, rating "O" was assigned (i.e., breakage or the like of the ceramic insulator, which could be caused by protrusion deformation, can be further reliably prevented). Meanwhile, when deformation of the protrusion or concave deformation of the diameter-decreasing portion was determined in at least one of the five samples, rating "Δ" was assigned.

The gas-tightness evaluation test was carried out on a plurality of samples having the same Hvo and Hvi. When the 10 cc leakage temperature was 200° C. or higher (with 95% confidence interval), rating "O" was assigned (i.e., further excellent gas-tightness can be secured). Meanwhile, when the 10 cc leakage temperature was lower than 200° C. (with 95% confidence interval), rating "Δ" was assigned.

Table 2 shows the results of both tests. Hvi or Hvo was changed by regulating, for example, a load applied in the crimping step.

TABLE 2

| | | | | | | |
|---|---|---|---|---|---|---|
| Copper packing | Hvo (Hv) | 115 | 120 | 125 | 140 | 145 |
| | Hvi (Hv) | 113 | 117 | 110 | 111 | 109 |
| | Hvo/Hvi | 1.018 | 1.026 | 1.136 | 1.261 | 1.330 |
| | Protrusion deformation evaluation | ○ | ○ | ○ | ○ | Δ |
| | Gas-tightness evaluation | Δ | ○ | ○ | ○ | ○ |
| Iron packing | Hvo (Hv) | 197 | 200 | 215 | 248 | 252 |
| | Hvi (Hv) | 193 | 195 | 192 | 198 | 192 |
| | Hvo/Hvi | 1.021 | 1.026 | 1.120 | 1.253 | 1.313 |
| | Protrusion deformation evaluation | ○ | ○ | ○ | ○ | Δ |
| | Gas-tightness evaluation | Δ | ○ | ○ | ○ | ○ |
| SUS packing | Hvo (Hv) | 203 | 209 | 241 | 255 | 268 |
| | Hvi (Hv) | 199 | 204 | 213 | 203 | 208 |
| | Hvo/Hvi | 1.020 | 1.025 | 1.131 | 1.256 | 1.288 |
| | Protrusion deformation evaluation | ○ | ○ | ○ | ○ | Δ |
| | Gas-tightness evaluation | Δ | ○ | ○ | ○ | ○ |

As is clear from Table 2, protrusion deformation was further reliably prevented in a sample in which a relation of Hvo/Hvi≤1.25 was satisfied. Conceivably, this is attributed to the fact that the load applied from an outer peripheral portion of the plate packing toward the protrusion (diameter-decreasing portion) did not become excessively larger than that applied from an inner peripheral portion of the plate packing toward the protrusion (diameter-decreasing portion).

A sample in which a relation of 1.03≤Hvo/Hvi was satisfied was found to secure further excellent gas-tightness. Conceivably, this is attributed to the fact that a well-balanced relationship was achieved between increased adhesion of an inner peripheral portion of the plate packing to the engagement portion or the diameter-decreasing portion and increased contact pressure of an outer peripheral portion of the plate packing against the engagement portion or the diameter-decreasing portion.

The aforementioned test data indicate that satisfaction of a relation of 1.03≤Hvo/Hvi≤1.25 is preferred, from the viewpoints of further improving gas-tightness, and more effectively preventing breakage or the like of the ceramic insulator caused by protrusion deformation.

The present invention is not limited to the above-described embodiment, but may be implemented, for example, as follows. Needless to say, applications and modifications other than those exemplified below are also possible.

(a) In the above-described embodiment, the threaded portion 15 has a relatively small diameter (e.g., M12 or less). However, the present invention may be applied to a spark plug in which the threaded portion 15 has a relatively large diameter.

(b) In the spark plug 1 of the above-described embodiment, spark discharge occurs at the gap 28. However, no particular limitation is imposed on the configuration of a spark plug to which the technical idea of the present invention can be applied. Thus, the technical idea of the present invention may be applied to, for example, a spark plug in which high-frequency power is supplied to a gap, whereby plasma is generated at the gap (i.e., a plasma spark plug), or a spark plug in which a ceramic insulator has a cavity at a forward end portion thereof, and plasma generated at the cavity is jetted (i.e., a plasma jet spark plug).

(c) In the above-described embodiment, the plate packing 22 employed in the placement step is configured such that the first end surface 22F and the second end surface 22B are inclined downwardly toward the central axis CL2 of the plate packing 22. However, no particular limitation is imposed on the shape of the plate packing 22 employed in the placement step. Thus, there may be employed, for example, a plate packing configured such that each of the first end surface 22F and the second end surface 22B extends in a direction orthogonal to the central axis CL2 (i.e., a horizontally extending plate packing). In the case where such a horizontally extending plate packing is employed, when the plate packing is pressed by means of the pressing die 53 at such a small load that breakage (e.g., cracking) does not occur in the ceramic insulator 2, the plate packing can be placed so that the first end surface 22F and the second end surface 22B are inclined downwardly toward the central axis CL2.

(d) In the above-described embodiment, the present invention is applied to a spark plug in which the ground electrode 27 is bonded to the forward end of the metallic shell 3. However, the present invention may be applied to a spark plug in which its ground electrode is formed, through machining, from a portion of the metallic shell (or a portion of a forward end metal piece welded to the metallic shell in advance) (see, for example, Japanese Patent Application Laid-Open (kokai) No. 2006-236906).

(e) In the above-described embodiment, the tool engagement portion 20 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: spark plug
2: ceramic insulator (insulator)
3: metallic shell
4: axial hole
5: center electrode
14: engagement portion
21: protrusion
21A: diameter-decreasing portion
22: plate packing
22B: second end surface (of plate packing)
22F: first end surface (of plate packing)
CL1: axial line
CL2: central axis (of plate packing)
SL1: first line segment
SL2: second line segment
CP1: midpoint (of first line segment)
CP2: midpoint (of second line segment)

The invention claimed is:

1. A spark plug comprising:

a tubular insulator having an axial hole extending in a direction of an axial line;

a center electrode inserted into a forward portion of the axial hole; and a tubular metallic shell provided around the insulator and having a protrusion projecting inwardly in a radial direction, wherein the protrusion has a diameter-decreasing portion whose diameter decreases toward the forward end of the metallic shell, the insulator has, on an outer wall thereof, an engagement portion whose diameter decreases toward the forward end of the insulator, the engagement portion seats on the diameter-decreasing portion of the protrusion via an annular seat packing, the seat packing is disposed on a cross section including the axial line so as to contain a first line segment extending, in the direction of the axial line, between the rear end of the engagement portion and the diameter-decreasing portion, and on a longitudinal cross section including the axial line, relationships of $\theta s > \theta p$ and $Hvo > Hvi$ are satisfied, where;

$\theta p$ represents an acute angle (°) between a straight line orthogonal to the axial line and the contour of the engagement portion, and $\theta s$ represents an acute angle (°) between a straight line orthogonal to the axial line and the contour of the diameter-decreasing portion, and Hvo represents the Vickers hardness (Hv) of the seat packing at the midpoint of the first line segment, and Hvi represents the Vickers hardness (Hv) of the seat packing at the midpoint of a second line segment extending, in the direction of the axial line, between the engagement portion and the forward end of the diameter-decreasing portion which is in contact with the seat packing.

2. A spark plug according to claim 1, wherein a relationship of $1.03 \leq Hvo/Hvi \leq 1.25$ is satisfied.

3. A method for producing a spark plug as recited in claim 1, the method comprising:

a placement step of placing the insulator in the metallic shell so that the seat packing is placed between the diameter-decreasing portion and the engagement portion; and a crimping step of applying a load to a rear end portion of the metallic shell in a direction of the axial line toward the forward end of the metallic shell, and bending the rear end portion of the metallic shell inwardly in a radial direction, to thereby fix the metallic shell to the insulator so that the seat packing is sandwiched between the diameter-decreasing portion and the engagement portion, wherein, on a longitudinal cross section of the seat packing provided in the placement step, the cross section including a central axis of the seat packing, an acute angle $\theta pp$ (°) between a straight line orthogonal to the central axis and the contour of a first end surface of the seat packing which faces the engagement portion is equal to $\theta p$, and an acute angle $\theta ps$ (°) between a straight line orthogonal to the central axis and the contour of a second end surface of the seat packing which faces the diameter-decreasing portion is equal to $\theta s$.

4. A method for producing a spark plug as recited in claim 2, the method comprising:

a placement step of placing the insulator in the metallic shell so that the seat packing is placed between the diameter-decreasing portion and the engagement portion; and a crimping step of applying a load to a rear end portion of the metallic shell in a direction of the axial line toward the forward end of the metallic shell, and bending the rear end portion of the metallic shell inwardly in a radial direction, to thereby fix the metallic shell to the insulator so that the seat packing is sandwiched between the diameter-decreasing portion and the engagement portion, wherein, on a longitudinal cross section of the seat packing provided in the placement step, the cross section including a central axis of the seat packing, an acute angle $\theta pp$ (°) between a straight line orthogonal to the central axis and the contour of a first end surface of the seat packing which faces the engagement portion is equal to $\theta p$, and an acute angle θps (°) between a straight line orthogonal to the central axis and the contour of a second end surface of the seat packing which faces the diameter-decreasing portion is equal to θs.

* * * * *